United States Patent [19]

Sorrells

[11] 4,161,799

[45] Jul. 24, 1979

[54] MOP CLEANING DEVICE

[76] Inventor: Weldon B. Sorrells, 830 Leigh Mill Rd., Great Falls, Va. 22066

[21] Appl. No.: 611,244

[22] Filed: Sep. 8, 1975

Related U.S. Application Data

[63] Continuation-in-part of Ser. No. 462,076, Apr. 18, 1974, abandoned.

[51] Int. Cl.[2] ..... A47L 13/14

[52] U.S. Cl. ..... 15/260; 15/264

[58] Field of Search ..... 15/260, 261, 264, 262; 220/22, 20, 16, 17; 210/167

[56] References Cited

U.S. PATENT DOCUMENTS

| | | | |
|---|---|---|---|
| D. 139,569 | 5/1944 | O'Brien | 15/264 |
| 577,030 | 2/1897 | Higgins | 15/262 |
| 1,164,050 | 12/1915 | Zodac | 220/22 |
| 1,486,284 | 3/1924 | Eiffe | 15/261 |
| 1,488,930 | 4/1924 | Mannix | 15/264 |
| 1,922,981 | 8/1933 | Robertson | 15/262 |
| 2,577,496 | 12/1951 | Wolfer | 15/260 |
| 2,712,668 | 7/1955 | Thiele | 15/264 |

*Primary Examiner*—Lenard A. Footland

*Attorney, Agent, or Firm*—Cushman, Darby & Cushman

[57] ABSTRACT

A mop cleaning device for use in mopping floors includes a container having a special partition which divides the interior of the container into first and second side-by-side compartmments which are in communication with each other in a manner such that water wrung from a wet mop into the first compartment displaces an equal amount of relatively solids-free liquid from the first compartment into the second compartment for re-use.

5 Claims, 6 Drawing Figures

MOP CLEANING DEVICE

This is continuation-in-part of application Ser. No. 462,076, filed Apr. 18, 1974 now abandoned.

BACKGROUND AND SUMMARY OF THE INVENTION

It has been well known in the prior art to divide a bucket to be used for mopping into two compartments. The purpose of dividing a bucket into compartments has always been to maintain different liquids placed in each compartment, such as a washing liquid and a rinsing liquid, separate from each other as shown by U.S. Pat. Nos. 1,164,050, 1,486,284 and 3,280,418. The provision of a horizontal strainer in a bucket to allow dirt and sediment to settle to the bottom of a bucket and thereby remain separated from the water in the bucket, is also known—as exemplified by U.S. Pat. No. 2,712,668.

The present invention provides a compartmentalized container such as a portable bucket or wall mounted sink with a special partition arrangement which permits controlled recirculation of liquid between compartments as a mop is repeatedly dipped and wrung out and which thereby facilitates the cleaning of a larger floor area before it becomes necessary to replace the liquid. According to the broad teachings of the present invention, the interior of a mop bucket or a wall-mounted sink is partitioned into first and second compartments by a special partition means which defines a flow passage for passing increments of relatively clean solids-free liquid from the first compartment into the second compartment during use of the bucket in conjunction with a mop. Liquid is received into the first compartment by wringing a mop thereinto and the liquid in this compartment continually undergoes "treatment" in the sense that solids are removed from the liquid by settling and/or filtering and in the sense that any floatable material such as oil rises to the surface and is retained there. This first compartment will hereinafter be referred to as the treatment compartment. The second compartment will be referred to as the dip compartment.

In use of the device, both compartments are first filled with liquid. A used mop is dipped in the dip compartment, and then the wet mop is then placed over the body of liquid in the treatment compartment and is wrung out, thereby adding an increment of dirty liquid to the treatment compartment. The wrung-out mop is then used in the conventional manner to clean a floor, after which the mop is again dipped in the dip compartment. The wringing, mopping and dipping cycle is of course repeated many times in the course of mopping a large area.

Referring more specifically to the operation of the treatment compartment it should be kept in mind that the liquid therein is not subject to any significant agitation because the mop is not placed in that liquid. Rather, the mop is wrung out above the treatment compartment so that the liquid therein remains relatively quiet. As a result grit and dense solids settle to the bottom of the treatment chamber leaving the liquid therein in a relatively solids-free condition. At the same time any oil or other floatable material which enters the treatment compartment rise to the surface and remain there.

The addition of each wrung-out increment of excess liquid to the treatment compartment raises the level of liquid therein and this causes an equal volume of liquid to be displaced from the lower part of the treatment compartment through the flow passage in the partition into the upper portion of the dip compartment. In the early stages of mopping with a freshly filled bucket the displaced increment of liquid is relatively clean because the displaced liquid is fresh liquid which has never been in contact with the mop. More important, however, is that with continued use of the bucket in conjunction with a mop there is a continuous recirculation of relatively solids-free liquid from the treatment compartment into the dip compartment and of liquid from the dip compartment, by way of a wet mop, into the treatment compartment, combined with solids removal and retention in the treatment compartment. The result is that the liquid remains cleaner for a substantially greater number of moppings than if the mop were merely rinsed in the total volume of the device.

Any grit or other insoluble particulate material which is removed from the mop in the dip compartment either remains in suspension or tends to settle to the bottom. A horizontal strainer may be placed near the bottom of the dip compartment for allowing the grit to pass downwardly and to prevent re-suspension of the grit when a mop is rinsed or dipped. A fine-pored filter may be placed near the bottom of the treatment compartment or in the flow passage for filtering solid particles from the liquid which is displaced. A bed of sand placed in the bottom of the treatment compartment up to a level higher than the opening into the flow passage, provides a suitable filter. Under mopping conditions where coarse grit forms a bed in the treatment compartment the bed may serve as a filter. A bed of fine particles will obstruct the flow of liquid, and when such a bed forms the bucket should be emptied and refilled with fresh liquid.

It will be appreciated that the connection of the flow passage with the treatment compartment below the level of liquid therein prevents freshly wrung-out increments of solids-containing liquid from flowing directly through the passage into the dip compartment. This configuration is important also in that oil and grease removed from the mop by wringing are retained in the treatment compartment, floating on the surface of the liquid therein. When an oily mop is dipped in the dip compartment some of the oil may be removed from the mop and float on the surface of the liquid in the dip compartment. However, subsequent dipping and wringing operations will transfer this oil to the treatment compartment where it will be retained.

The special partition means may be an integral part of the entire two-compartment container or it may be part of an insert which is added to an existing container. For example, the insert may be a bucket-like container constructed with the partition means forming a side wall thereof. The interior of the insert may be the equivalent of the above-described treatment compartment so that when the insert is placed in a larger container, the remainder of the container serves as the dip compartment.

DETAILED DESCRIPTION

The invention will be further understood from the following detailed description of several embodiments taken with the drawings in which.

Figure 1:
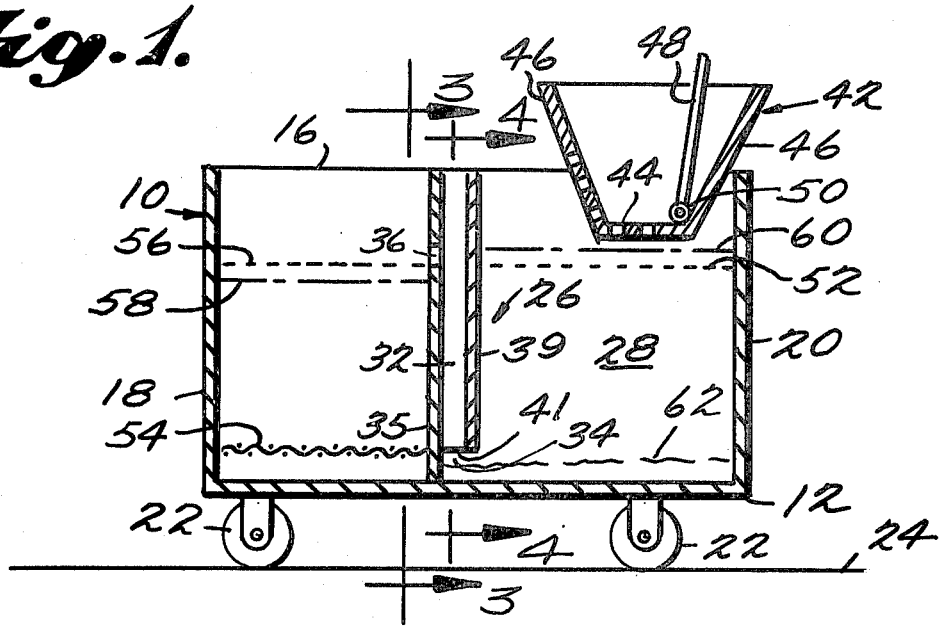
FIG. 1 is a schematic vertical sectional view of a mop bucket embodying the principles of the present invention.
Figure 2:
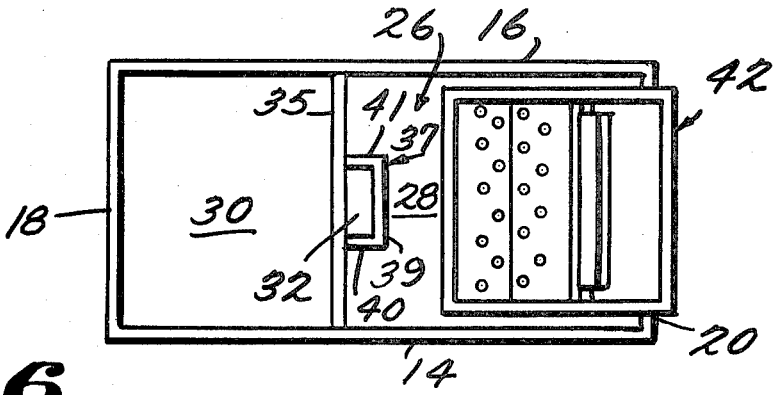
FIG. 2 is a plan view of the mop bucket of FIG. 1.
Figure 6:
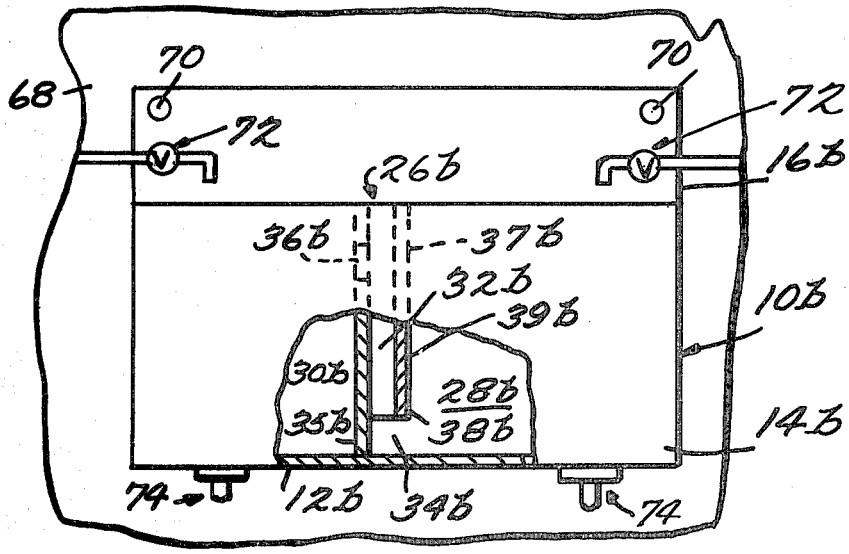
Figure 3:
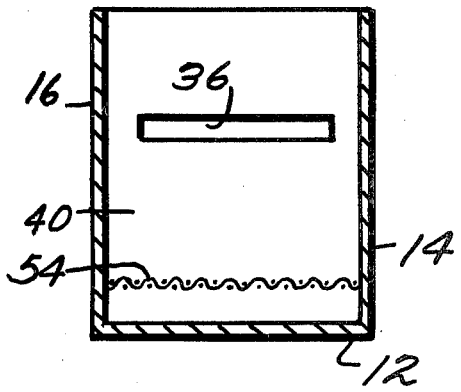
Figure 4:
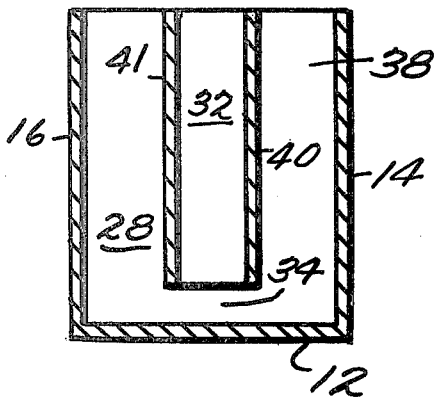
Figure 5:
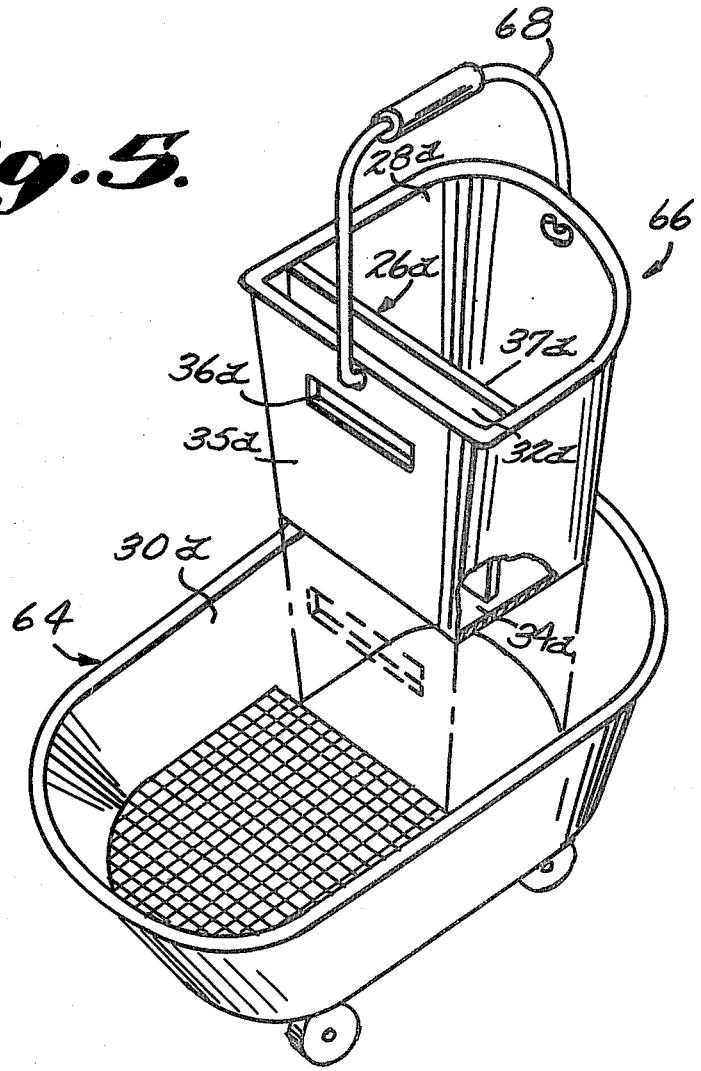

FIGS. 3 and 4 are sectional views taken on the lines 3—3 and 4—4, respectively, in FIG. 1;

FIG. 5 is a perspective view of a bucket insert embodying the principles of the present invention, shown with a conventional mop bucket; and FIG. 6 is a schematic front view of a wall mounted device embodying the principles of the present invention.

In FIGS. 1, 2, 3 and 4 there is shown schematically a mop cleaning device in the form of a bucket 10 having a bottom wall 12, a front wall 14, a rear wall 16 and end walls 18 and 20. The bucket 10 may be mounted on wheels 22 to aid in moving it along the floor 24.

Vertical partition means 26 extending between the walls 14 and 16 performs the following three functions: (1) it divides the interior of the bucket 10 into a first or treatment compartment 28 and a second or dip compartment 30, (2) it maintains a predetermined liquid level in the treatment compartment 28, and (3) it permits the displacement of liquid from the treatment compartment 28 to the dip compartment 30 when liquid is added to the treatment compartment 28 by wringing a mop thereinto. The partition means 26 forms a laterally enclosed upwardly extending passage 32 which communicates at its lower end 34 with the treatment compartment 28 only near the lower end portion thereof. The upper end 36 of the passage 32 communicates with the upper end portion of the dip compartment 30, whereby liquid wrung from a mop into the treatment compartment 28 displaces an equal volume of treated liquid upwardly from the lower end of the treatment compartment 28 into the dip compartment 30.

The illustrated partition means 26 is constructed of a vertical baffle 35 sealed to the walls 12, 14, 16 and a channel-shaped member 37 having a web portion 39 and two flange portions 40 and 41. The edges of the flange portions 40 and 41 are sealed to the baffle 35 thereby forming the passage 32. The lower end of the channel 37 terminates close to and above the bottom wall 12 thereby forming an opening which is the lower end 34 of the passage 32. The baffle 35 is provided with a slot or with perforations at an elevation near the top of the dip compartment 30 thereby defining the upper end 36 of the passage 32. If desired, the upper edge of the baffle 35 can terminate at the location of the slot in which case the upper end 36 of the flow passage 32 is merely the space above the upper edge of the baffle 35. In any event, however, the edge which defines the lower edge of the passage end 36 must always be below the lowermost portion of the rim of the bucket if the recirculation of liquid between compartments 28 and 30 is to be effected.

A mop wringer 42 of any desired construction is disposed in and above the upper portion of the treatment compartment 28. Generally, the wringer 42 will be supported on the upper edges of the walls 14, 16 and 20 in any convenient manner. The schematically illustrated wringer 42 includes a perforated bottom wall 44, perforated side walls 46, and a pressure element 48 hinged at its lower end 50. It is important that the bottom 44 of the wringer 42, or at least that portion of the wringer 42 which receives a mop head, be disposed above the normal liquid level 52 in the treatment compartment 28 because otherwise the mop head will reabsorb liquid as soon as the wringing action of the wringer 42 ceases.

A horizontal screen 54 may be disposed above the bottom of the dip compartment 30. Any dense insoluble material which may be removed from a mop being dipped in this compartment will settle through the screen 54 and the latter will prevent re-suspension of the material during subsequent dipping operations.

The typical use of the bucket 10 illustrated in FIGS. 1, 2, 3 and 4 is as follows. First, both compartments 28 and 30 are filled with liquid up to the level of the slot 36 in the baffle 35, this level being indicated at 52 for the treatment compartment 28 and at 56 for the dip compartment 30. A used mop is dipped into the dip compartment 30 compartment whereupon it absorbs liquid. The dripping wet mop is then wrung out into the treatment compartment 28 so that the mop remains damp. The mop is used to mop a floor in the conventional manner and is then again dipped in the dip compartment 30 and the cycle is repeated. Each time the mop is dipped into and removed from the dip compartment 30 an increment of liquid is removed from that compartment, thereby lowering the liquid level to 58. But as soon as the mop is wrung into the treatment compartment 28 the liquid level therein rises slightly to level 60. This causes an equal volume of liquid to be displaced from the lower end of the treatment compartment 28 up through the passage 32 and into the dip compartment. As the sequence of dipping, wringing, mopping and dipping is continued, there will be continuous recirculation of liquid between the compartments 28 and 30. That is, the liquid in the treatment compartment 28 will be transferred to the dip compartment 30, and essentially simultaneously the liquid in the dip compartment 30 is transferred by way of the mop and wringer 42 to the treatment compartment 28. The important feature is that the liquid which is displaced from the treatment compartment 28 is relatively clean liquid because this displaced liquid has been treated in the sense that solids have settled out and oil has risen. The overall result is that all the initial liquid in the bucket is re-used again and again and that simultaneously a portion of the liquid is undergoing a self-cleaning operation due to settling of solids in the treatment compartment 28. This means that a given initial amount of liquid can be used effectively for a much greater number of moppings than if the mop were merely re-dipped and wrung into a single compartment where resuspension of dirt particles would take place continuously.

It will be understood from the above description that the self-cleaning action of the device depends in large part on maintaining the liquid in the treatment compartment 28 relatively free from agitation so that dense solids will settle and oil will form a floating layer. Also important is the vertical spacing between the lower and upper ends of the flow passage 32, because this aids in preventing displacement of solids-containing liquid from the treatment compartment 28 into the dip compartment 30. That is, the upward movement of liquid through the passage 32 tends not to disturb solids which have settled to the bottom of the treatment compartment. Also, the vertical passage increases the length of the path along which each increment of liquid must travel from the time it enters the treatment compartment to the time it enters the dip compartment, and this aids in the settling of solids. Futher, the elevated position of the upper end of the passage 32 assures that the treatment compartment 28 remains full up to that level during continued use in conjunction with a mop. The liquid level in the dip compartment will drop during continued use, due to loss of liquid to the floor being mopped.

FIG. 5 illustrates a cleaning device in the form of a conventional one-chamber bucket 64 having an insert 66 therein for converting the bucket 64 to the liquid-recirculating type of bucket illustrated in FIGS. 1–4. In the illustrated embodiment the insert 66 is a bucket-shaped structure of lesser horizontal cross-section than the bucket 64. A handle 68 may be provided for placing and removing the insert 66. The interior of the insert 66 forms one compartment and the unoccupied volume of the bucket 64 forms the other compartment. One of the side walls of the insert is constructed in the form of a vertical partition means 26*a* which is structurally and functionally the same as the partition means 26 of the embodiment of FIGS. 1–4. Thus the partition means 26*a* includes baffles 35*a* and 37*a* which define between them a flow passage 32*a* having a lower end 34*a* and an upper end 36*a*. In this embodiment, then, the interior of the insert 66 is the treatment compartment 28*a* and the remainder of the interior of the bucket 64 is the dip chamber 30*a*. Alternatively, the insert could be constructed with its interior being disposed immediately adjacent the baffle 35*a* in which case the insert would define the dip chamber rather than the treatment chamber.

FIG. 6 illustrates a mop cleaning device in the form of a wall-mounted sink 10*b*. The sink may be essentially the same as that disclosed in my prior U.S. Pat. No. 3,076,202, incorporated by reference, with the addition of a special partition means of the kind described above. In the schematically illustrated embodiment the rear wall 16*b* of the sink is extended upwardly above the compartments 28*b* and 30*b* and is secured to a building wall 68 by means of fasteners 70. Between the compartments 28*b* and 30*b* is a partition means 26*b* which is structurally and functionally the same as the partition means 26*b* of the embodiment of FIGS. 1–4. That is, a partition 35*b* is sealed to the walls 12*b*, 14*b* and 16*b*, and a channel member 37*b* is sealed to one side of the partition to form a flow passage 32*b*. Each compartment 28*b* and 30*b* is provided with a valved tap water inlet 72 and with a valved outlet 74 connected with a sewer line.

What is claimed is:

1. A mop cleaning device comprising: an open-top container having a bottom and an enclosing side wall; and vertical partition means within the container for dividing the interior of the bucket into first and second compartments, and for maintaining a predetermined liquid level in the first compartment and for permitting displacement of liquid from the lower end of the first compartment to the upper end of the second compartment when liquid is added to the upper end of the first compartment by wringing of a mop thereinto, said means forming a laterally enclosed upwardly extending passage communicating at its lower end with the first compartment only near the lower end portion thereof and communicating at its upper end with the second compartment near the upper end thereof, whereby liquid wrung from a mop into the first compartment displaces an equal amount of liquid upwardly from the lower end of the first compartment into the second compartment; and a mop wringer associated with said first compartment at a position in which liquid wrung from a mop drops into said first compartment, said wringer being located above the level of the upper end of said passage and being supported by said container, whereby wringing of a mop does not agitate the liquid in said first compartment.

2. A bucket-shaped insert for placement in a mop cleaning container to divide the interior of the container into a first compartment formed by the interior of the insert and a second compartment, said insert having a bottom wall and a continuous side wall and including means forming a laterally enclosed upwardly extending passage having a lower end communicating with the interior of the insert only near the lower end thereof and having an upper end terminating in a laterally facing opening which communicates with the exterior of the insert.

3. A mop cleaning device comprising a bucket having a bottom and a circumscribing side wall; a bucket-shaped insert of lesser horizontal cross-sectional area disposed in said container thereby dividing the interior of said container into first and second compartments one of which is defined by the interior of said insert and the other being defined by the remainder of the interior of said container, said insert having a side wall which is constructed as a vertical partition means between said compartments for maintaining a predetermined liquid level in said first compartment and for permitting displacement of liquid from said first compartment to said second compartment when liquid is added to said first compartment by wringing a mop thereinto, said vertical partition means forming a laterally enclosed upwardly extending passage communicating at its lower end with the first compartment only near the lower end portion thereof and communicating at its upper end with the second compartment near the upper end thereof, whereby liquid wrung from a mop into the first compartment displaces an equal amount of liquid upwardly from the lower end of the first compartment into the second compartment.

4. A method of cleaning a mop comprising: dipping the mop in the second of two liquid-containing compartments disposed side-by-side in a container; wrining the mop into the first compartment from a position above the liquid level therein thereby raising said liquid level without reabsorbing liquid into the mop, displacing liquid from the lower portion of said first compartment through a passage into the upper portion of said second compartment in response to the rise in liquid level in said first compartment; again dipping the mop, after use on a floor, in said second compartment and wringing it into said first compartment; and repeating the dipping and wringing steps so that liquid is continually circulated from said first compartment through the passage to said second compartment and from said second compartment, by way of the mop, to said first compartment.

5. A mop cleaning device comprising an open-top container formed by a bottom and by an enclosing side wall, a baffle in said container dividing the interior thereof into first and second side-by-side compartments, means forming a laterally enclosed vertial passage for displacing to said second compartment an increment of liquid equal in volume to an increment of liquid added to said first compartment, said passage having a lower end disposed near and in communication with the lower end portion of said first compartment, said passage also having an upper end disposed near and in communication with said second compartment at an elevation above the level of said lower end and below the entire upper edge of said side wall such that both said compartments can be filled with liquid up to the level of said upper end of said passage, whereby liquid will be displaced from the lower end portion of said first chamber to the upper end portion of said second chamber upon addition of liquid to said first chamber, and a mop wringer associated with said first compartment, said wringer having a bottom disposed at an elevation above the upper end of said passage.

* * * * *